US005713729A

United States Patent [19]

Hong

[11] Patent Number: 5,713,729

[45] Date of Patent: Feb. 3, 1998

[54] PUMP HAVING A THREE-WAY VALVE

[75] Inventor: Woong-Sub Hong, Incheon, Rep. of Korea

[73] Assignee: Daewoo Electronics Co., Ltd., Seoul, Rep. of Korea

[21] Appl. No.: 766,201

[22] Filed: Dec. 12, 1996

[30] Foreign Application Priority Data

Dec. 13, 1995 [KR] Rep. of Korea ..... 95-49391

[51] Int. Cl.[6] ..... F01D 7/18

[52] U.S. Cl. ..... 417/423.14; 417/442; 417/505; 415/151; 137/625.4; 137/625.44

[58] Field of Search ..... 417/423.14, 442, 417/505; 415/148, 151; 251/129.09; 137/625.4, 625.44

[56] References Cited

U.S. PATENT DOCUMENTS

| | | | |
|---|---|---|---|
| 2,177,220 | 10/1939 | McQuaid | 137/625.4 |
| 2,750,960 | 6/1956 | Hansen et al. | 251/129.09 X |
| 4,248,570 | 2/1981 | Congen | 417/423.4 X |
| 4,450,897 | 5/1984 | Moore | 137/625.44 |
| 5,486,089 | 1/1996 | Chung | 47/442 X |

FOREIGN PATENT DOCUMENTS

| | | | |
|---|---|---|---|
| 1010002 | 2/1962 | United Kingdom . | |
| 891076 | 3/1962 | United Kingdom . | |
| 1 134 228 | 11/1968 | United Kingdom . | |
| 1 476 168 | 6/1977 | United Kingdom . | |
| 2032522 | 5/1980 | United Kingdom | 417/442 |

*Primary Examiner*—Richard E. Gluck
*Attorney, Agent, or Firm*—Lowe, Price, LeBlanc & Becker

[57] ABSTRACT

A pump having a three-way valve has a motor for generating a turning effect by an electric power applied thereto. The pump pressurizes a fluid by using an impeller. The three-way valve is installed to the inlet side of the pump. A magnetic plate and ball swing between the first inlet and second inlet by means of load switches as many as a predetermined angle. The pump and three-way valve are integrally formed to require no separate piping between the three-way valve and pump. Thus, the manufacturing processing of the boiler is reduced while enhancing productivity. An installation space is shrunken to decrease the external dimensions of a product such as boilers.

4 Claims, 2 Drawing Sheets

PUMP HAVING A THREE-WAY VALVE

BACKGROUND OF THE INVENTION

1. Field of the Invention

The present invention relates to a pump having a three-way valve obtained by integrally coupling a pump for pressurizing a supply fluid with a three-way valve for shifting the direction of fluid in a flow passage in a body.

2. Description of the Prior Art

A boiler is generally employed with a circulating pump for circulating heating water therethrough and a three-way valve for shifting the direction of water in the flow passage of the heating water. A gas boiler, especially, is installed with a circulating pump and a three-way valve which are independently furnished therein. The circulating pump functions for forcibly circulating heated water, and the three-way valve serves for shifting the direction of water in the flow passage to utilize the heated water.

Therefore, the circulating pump and three-way valve are installed adjacent to each other. However, the circulating pump and three-way valve employed within the conventional gas boiler are individually installed to enlarge the installation space. Since the circulating pump and three-way valve are connected by means of a pipe, it is disadvantageous in that the manufacturing process is increased. Furthermore, if necessary, the pipe should be detoured for avoiding contact with peripheral parts, but if not, that will increase needless manufacturing process and make the external dimensions of the boiler more bulky.

SUMMARY OF THE INVENTION

Therefore, it is an object of the present invention to provide a pump having a three-way valve for economizing installation space by integrally furnishing the three-way valve which shifts the direction of fluid in a flow passage into the pump which pressurizes a fluid.

To achieve the above object of the present invention, there is provided a pump having a three-way valve which includes a pump apparatus for pressurizing a fluid by the rotation of a motor, and a three-way valve installed to an inlet side of the pump apparatus for shifting a receiving flow passage, as required.

Preferably, the pump apparatus is comprised of a motor for generating a turning force, and an impeller fitted onto a rotating shaft of the motor. Also, an impeller case encloses the impeller and an inlet and an outlet.

Preferably the three-way valve includes the first inlet for receiving the fluid into the pump apparatus, and the second inlet spaced apart from the first inlet at a predetermined distance. In addition, a shifting device selectively communicates either the first inlet or the second inlet with the pump apparatus.

The first inlet and second inlet are installed to be spaced apart at an angle from each other originating from the rotating shaft.

More preferably, the shifting device is formed by a ball for selectively opening/closing the first inlet and the second inlet, a magnetic plate installed to the ball, and a pair of load switches installed to the outer front surface of the ball case enclosing the ball. The pair of load switches are spaced apart from each other for selectively applying an attractive force upon the magnetic plate.

The magnetic plate may be installed to one end of a ball axle which penetrates through a center of the ball, and the ball and magnetic plate may swing about the rotating shaft of the motor.

Alternatively, a pump having a three-way valve includes a motor for producing a turning force, and an impeller fitted onto a rotating shaft of the motor for pressurizing a fluid. Additionally, an impeller case is formed with a first inlet for receiving the fluid, a second inlet spaced apart from the first inlet at an angle originating from the rotating shaft and an outlet for discharging the pressurized fluid. Also, a ball swings by centering about the rotating shaft for selectively opening/closing the first inlet and the second inlet, and a magnetic plate is installed to one end of a ball axle which penetrates through a center of the ball. A pair of load switches are installed to the outer front surface of a ball case, the load switches being spaced apart from each other for selectively applying an attractive force upon the magnetic plate.

The pump having the three-way valve constructed as above is operated as follows.

Once the electric power is supplied to the motor, the motor is rotated to concurrently rotate the impeller. By the rotation of the impeller, the fluid is received into the interior of the impeller case via the inlet and is then discharged through the outlet.

At this time, if either one of the pair of load switches operates, the attractive force is applied to the magnetic plate to swing the ball. As a result of the swinging motion of the ball, the first inlet is opened and the second inlet is closed. Otherwise, the first inlet is closed and the second inlet is opened. In other words, the fluid flows from the first inlet to the outlet by the rotation of the impeller or from the second inlet to the outlet via the impeller.

Consequently, the pump having the three-way valve according to the present invention operated as above is more effective because separate piping between the three-way valve and pump is not required. Also, the installation space is reduced to decrease the external dimensions of a finished product such as a boiler.

BRIEF DESCRIPTION OF THE DRAWINGS

The above objects and other advantages of the present invention will become more apparent by describing in detail preferred embodiments thereof with reference to the attached drawings in which.

DETAILED DESCRIPTION OF THE PREFERRED EMBODIMENT

A pump having a three-way valve according to the present invention will be described in detail with reference to a preferred embodiment shown in FIGS. 1, 2, and 3.

Figure 1:
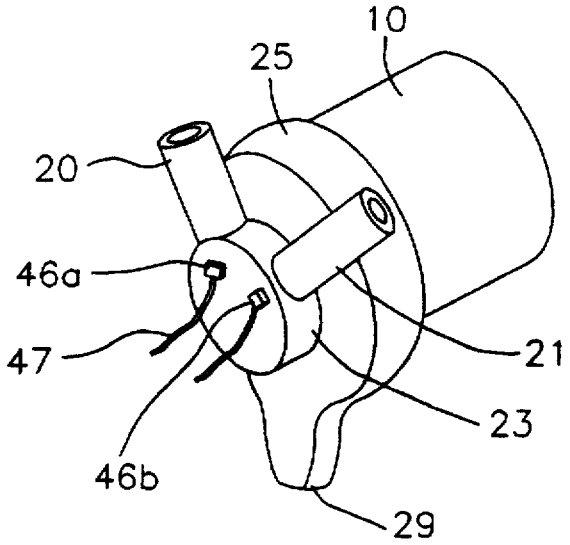
FIG. 1 is a perspective view showing a pump having a three-way valve according to the present invention.

FIG. 1 is a perspective view showing the pump having the three-way valve according to the present invention. A pump case 10 is assembled within one side of an impeller case 25, and a three-way valve is provided within the other side of impeller case 25. An outlet 29 for discharging a pressurized fluid is formed from the lower end of impeller case 25 which is shaped as a cylinder for allowing an impeller 27 to rotate therein.

In the upper end of the three-way valve, a first inlet 20 and a second inlet 21 are installed to be spaced apart at an angle originating from the rotating shaft. The first inlet 20 and the second inlet 21 are fixed to a ball case 23. A pair of load switches 46a and 46b are attached to the outer front side of ball case 23. The pair of load switches 46a and 46b are spaced apart from each other at an angle which is the same as the angle between the first inlet 20 and second inlet 21. Since load switch 46 produces a magnetic force when electric power is applied, a separate electric wire 47 is connected.

Figure 2:
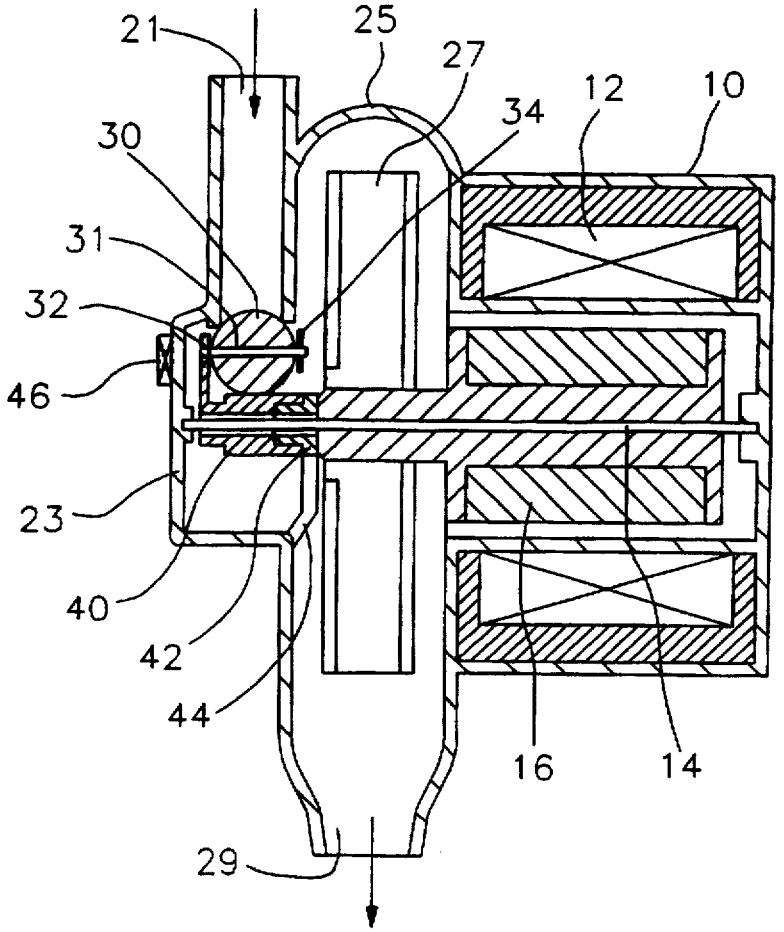
FIG. 2 is a sectional view showing the pump having the three-way valve shown in FIG. 1.

FIG. 2 is a sectional view showing the pump having the three-way valve illustrated in FIG. 1. As shown in FIG. 2, the pump having the three-way valve largely consists of a motor, impeller, and three-way valve.

The motor is formed from a coil 12 fixed to the interior of pump case 10, a rotor 16 rotatable about the center of the coil 12, and a rotating shaft 14 for transmitting the rotary motion of rotor 16.

The impeller 27 press-fitted onto rotating shaft 14 to be rotatable is installed within the interior of impeller case 25. An outlet 29 for discharging the pressurized fluid is formed from the lower end of impeller case 25.

A ball 30 is spherically-shaped to block the flow of the fluid when the ball is closely attached to the end portion of second inlet 21. A ball axle 31 penetrates through the center of ball 30. One end of ball axle 31 is fitted with a pin 34 which prevents the ball 30 from deviating from the position of the ball 30, and the other end thereof is fixed to a magnetic plate 32.

The magnetic plate 32 is formed to extend from a valve rotating shaft 40. Valve rotating shaft 40 is fitted onto rotating shaft 14, and is capable of performing a relative swinging motion with respect to rotating shaft 14. A supporting shaft 42 for supporting rotating shaft 14 is installed between valve rotating shaft 40 and impeller 27. Supporting shaft 42 is supported by a connection plate 44 which protrudes from ball case 23.

Load switch 46 is installed to the outer front surface of ball case 23 at a portion corresponding to magnetic plate 32.

Alternatively, a single switch which is comprised of one hinge bar having an extending lead wire and two points for selectively contacting with the one hinge bar may be employed.

Figure 3:
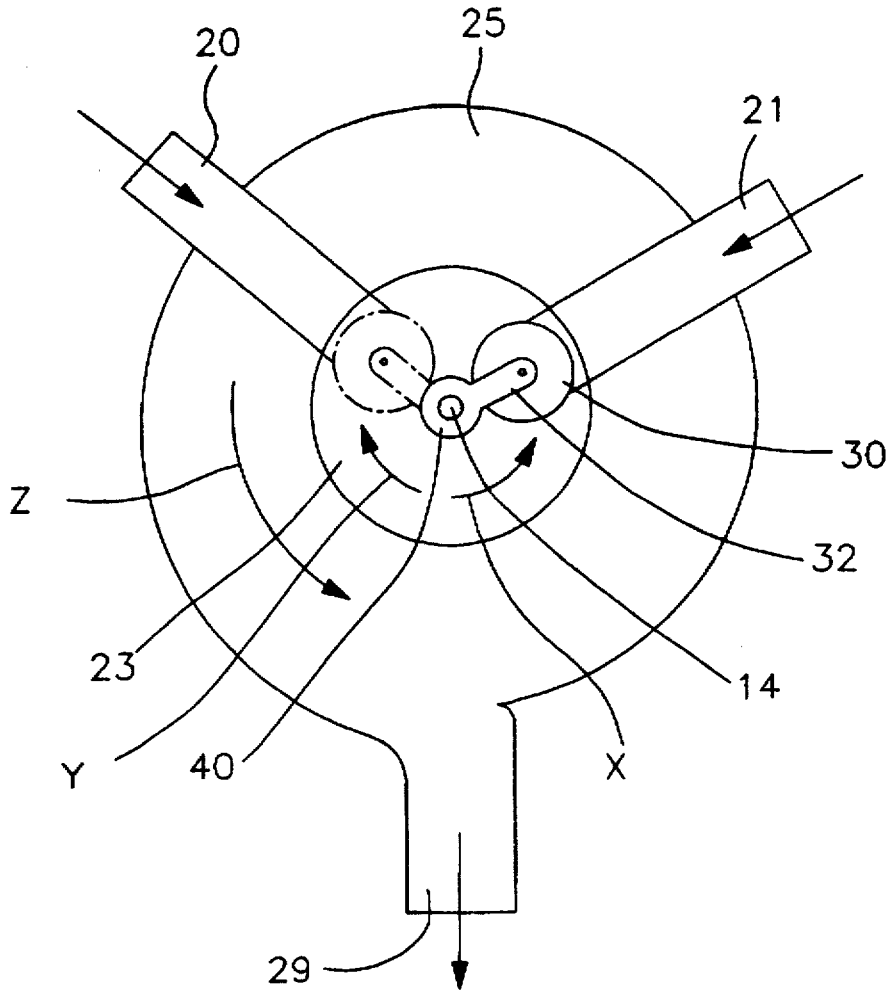
FIG. 3 is a front view diagrammatically showing an operation of the pump having the three-way valve shown in FIG. 1.

FIG. 3 is a front view diagrammatically showing an operation of the pump having the three-way valve shown in FIG. 1. Referring to FIG. 3, first inlet 20 and second inlet 21 are installed to be spaced apart from each other at a predetermined angle based on centering about rotating shaft 14. Ball 30 and magnetic plate 32 can swing within ball case 23 to the extent of the distance between inlets 20, 21 measured by the angle of the two inlets at a point centered from the rotating shaft. Arrows X, Y shown within ball case 23 represent the opposite swinging directions of ball 30 and magnetic plate 32, and arrow Z within impeller case 25 represents the flow direction of the fluid.

The pump having the three-way valve according to the present invention constructed as above is operated as below.

While rotor 16 is rotated by the electric power supplied to the motor, rotating shaft 14 is rotated simultaneously. Accordingly, impeller 27 is rotated to pressurize the received fluid.

When first inlet 20 and outlet 29 are communicated with each other, the electric power is applied to load switch 46b. The magnetic force produced from load switch 46b serves as the attractive force upon magnetic plate 32 via ball case 23. Therefore, magnetic plate 32 swings toward second inlet 21 together with valve rotating shaft 40. At this time, ball 30 closes second inlet 21.

The fluid received within the interior of ball case 23 via first inlet 21 is pressurized by impeller 27, and is discharged through outlet 29.

When second inlet 21 and outlet 29 are to be communicated with each other, the electric power is applied to load switch 46a. The magnetic force produced from load switch 46a attracts magnetic plate 32 via ball case 23. Therefore, magnetic plate 32 swings toward first inlet 20 from the second inlet side together with valve rotating shaft 40. At this time, ball 30 closes first inlet 20. The operations of the pump and motor are carried out independently of that of the three-way valve.

The above-described pump having the three-way valve is not utilized within the gas boiler, but can be applied to machinery which requires the flow-passage shifting function and pressurizing function. Also, oil as well as water may be utilized as the fluid.

As a result, the pump having the three-way valve according to the present invention demands no separate piping between the three-way valve and pump. Consequently, the manufacturing processing of the boiler is decreased and productivity is enhanced. In addition, the installation space is reduced which is useful in minimizing the external dimensions of the finished product such as a boiler.

While the present invention has been particularly shown and described with reference to particular embodiment thereof, it will be understood by those skilled in the art that various changes in form and details may be effected therein without departing from the spirit and scope of the invention as defined by the appended claims.

What is claimed is:

1. A pump having a three-way valve comprising:

a pump apparatus having an impeller for pressurizing a fluid by the rotation of a motor; and a three-way valve installed to an inlet side of said pump apparatus for shifting the direction of receiving fluid in a flow passage;

said three-way valve comprising:

a first inlet for receiving said fluid into said pump apparatus;

a second inlet spaced apart from said first inlet at an angle originating from a rotating shaft line of said pump apparatus; and shifting means for selectively communicating either said first inlet or said second inlet with said pump apparatus, said shifting means consisting of:

a ball for selectively opening/closing said first inlet and said second inlet;

a magnetic plate installed to said ball; and a pair of load switches installed to an outer front surface of a ball case enclosing said ball to be spaced apart from each other for selectively applying an attractive force upon said magnetic plate.

2. The pump having a three-way valve as claimed in claim 1, wherein said magnetic plate is installed to one end of a ball axle which penetrates through a center of said ball.

3. The pump having a three-way valve as claimed in claim 2, wherein said ball and magnetic plate swing about said rotating shaft of said motor.

4. A pump having a three-way valve comprises:

a motor for producing a turning force;

an impeller fitted onto a rotating shaft of said motor for pressurizing a fluid;

an impeller case formed with a first inlet for receiving said fluid, a second inlet spaced apart from said first inlet at an angle originating from said rotating shaft line of said motor, and an outlet for discharging the pressurized fluid;

a ball swinging by centering about said rotating shaft for selectively opening/closing said first inlet and said second inlet;

a magnetic plate installed to one end of a ball axle which penetrates through a center of said ball; and a pair of load switches installed to the outer front surface of a ball case having said ball to be spaced apart at an angle for selectively applying an attraction force upon said magnetic plate.

* * * * *